US010495338B2

(12) United States Patent
Ino

(10) Patent No.: US 10,495,338 B2
(45) Date of Patent: Dec. 3, 2019

(54) REMOTE CONTROLLER SETTING DEVICE

(71) Applicant: Mitsubishi Electric Corporation, Tokyo (JP)

(72) Inventor: Masaoki Ino, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 134 days.

(21) Appl. No.: 15/567,293

(22) PCT Filed: May 20, 2015

(86) PCT No.: PCT/JP2015/064460

§ 371 (c)(1),
(2) Date: Oct. 17, 2017

(87) PCT Pub. No.: WO2016/185584

PCT Pub. Date: Nov. 24, 2016

(65) Prior Publication Data

US 2018/0149382 A1 May 31, 2018

(51) Int. Cl.

| | |
|---|---|
| ***F24F 11/59*** | (2018.01) |
| ***F24F 11/523*** | (2018.01) |
| ***F24F 11/67*** | (2018.01) |
| ***F24F 11/61*** | (2018.01) |

(52) U.S. Cl.

CPC ..... *F24F 11/59* (2018.01); *F24F 11/523* (2018.01); *F24F 11/61* (2018.01); *F24F 11/67* (2018.01)

(58) Field of Classification Search

None

See application file for complete search history.

(56) References Cited

U.S. PATENT DOCUMENTS

| | | | | |
|---|---|---|---|---|
| 6,469,751 | B1 * | 10/2002 | Isobe | H04N 5/44582 340/12.53 |
| 9,746,999 | B2 * | 8/2017 | Kurihara | G06F 3/0482 |
| 9,847,018 | B2 * | 12/2017 | e Silva | H04N 21/475 |
| 2005/0080949 | A1 * | 4/2005 | Vu | G06F 13/404 710/36 |
| 2012/0300134 | A1 * | 11/2012 | Slowinski | F16M 11/08 348/734 |

(Continued)

FOREIGN PATENT DOCUMENTS

| | | | |
|---|---|---|---|
| JP | 05215390 | A | 8/1993 |
| JP | H10-185316 | A | 7/1998 |

(Continued)

OTHER PUBLICATIONS

International Search Report of the International Searching Authority dated Aug. 4, 2015 for the corresponding international application No. PCT/JP2015/064460 (and English translation).

(Continued)

*Primary Examiner* — Carlos Garcia

(74) *Attorney, Agent, or Firm* — Posz Law Group, PLC

(57) ABSTRACT

A remote controller setting device includes a storage unit configured to store setting data on setting contents of a remote controller, and a communication unit connected to a communication line between the remote controller and a device to be operated by the remote controller and, in normal operation of the remote controller, is configured to transmit the setting data stored in the storage unit to the remote controller.

13 Claims, 15 Drawing Sheets

(56) References Cited

U.S. PATENT DOCUMENTS

| | | | | |
|---|---|---|---|---|
| 2014/0169564 | A1* | 6/2014 | Gautama | G07C 9/00309 380/270 |
| 2015/0007232 | A1* | 1/2015 | Martch | G08C 17/02 725/44 |
| 2015/0163945 | A1* | 6/2015 | Barton | H04L 67/025 361/809 |

FOREIGN PATENT DOCUMENTS

| | | | |
|---|---|---|---|
| JP | H11-337156 | A | 12/1999 |
| JP | 2005134083 | A | 5/2005 |
| JP | 2006128776 | A | 5/2006 |
| JP | 2006-183924 | A | 7/2006 |
| JP | 2006203461 | A | 8/2006 |
| JP | 2009246849 | A | 10/2009 |
| JP | 2010068088 | A | 3/2010 |
| JP | 2012063112 | A | 3/2012 |
| JP | 5575016 | B2 | 9/2012 |

OTHER PUBLICATIONS

Office Action corresponding to Japanese Patent Application No. 2017-518686 dated Jul. 3, 2018 with English translation.
Office Action dated Dec. 4, 2018 issued in corresponding JP patent application No. 2017-518686 (and English translation).

* cited by examiner

| MONDAY | | | |
|---|---|---|---|
| TIME | MODE | START/STOP | SET TEMPER-ATURE |
| 9:00 | HEATING | ON | 20℃ |
| 12:00 | | STOP | |
| 13:00 | HEATING | ON | 20℃ |
| 17:00 | | STOP | |
| 21:00 | HEATING | STOP | |

. . . .

| SUNDAY |
|---|
| . |
| . |
| . |
| . |

REMOTE CONTROLLER SETTING DEVICE

CROSS REFERENCE TO RELATED APPLICATIONS

This application is a U.S. national stage of International Patent Application No. PCT/JP2015/064460 filed on May 20, 2015, the contents of which are incorporated herein by reference.

TECHNICAL FIELD

The present invention relates to a remote controller setting device configured to set a handheld remote control device.

BACKGROUND ART

Typically in a handheld remote control device (hereinafter referred to as a "remote controller") for operation of an air-conditioning apparatus etc., settings of a schedule for operation of the air-conditioning apparatus, settings of a temperature unit and a language displayed on the remote controller, settings such as use or non-use of an operation mode, settings of time, etc. are manually made for each remote controller by means of button operation or touch panel operation. In a case where many remote controllers are placed at a large facility etc., the same setting needs to be manually made for each remote controller. This requires great time and effort for a setting process.

For reducing such setting processing burden, a technique has been proposed in, for example, Patent Literature 1 in which an interface unit for an external memory such as a USB memory is provided at a remote controller and the remote controller is set in such a manner that setting contents are read from the external memory storing the setting contents in advance.

CITATION LIST

Patent Literature

Patent Literature 1: Japanese Patent No. 5575016

SUMMARY OF INVENTION

Technical Problem

However, in the case of the configuration described in Patent Literature 1, the interface unit configured to read the data stored in the external memory needs to be provided at the remote controller. Thus, such a configuration exhibits low versatility, and cannot be applied to an existing remote controller. Moreover, providing the interface unit at the remote controller leads to an increase in manufacturing cost of the remote controller.

The present invention has been made to solve the above-described problems, and is intended to provide a remote controller setting device that ensures the reduction of a burden of a setting process of a remote controller and prevents a cost increase.

Solution to Problem

A remote controller setting device of one embodiment of the present invention includes a storage unit configured to store setting data on setting contents of a remote controller, and a communication unit connected to a communication line between the remote controller and a device to be operated by the remote controller and, in normal operation of the remote controller, configured to transmit the setting data stored in the storage unit to the remote controller.

Advantageous Effects of Invention

According to the remote controller setting device of an embodiment of the present invention, the setting data stored in the storage unit of the remote controller setting device is transmitted to the remote controller, and therefore, manual remote controller setting is not necessarily performed. Thus, a burden of a setting process of the remote controller can be reduced. Moreover, as the remote controller setting device is connected to the communication line of the remote controller, e.g., an additional interface unit for an external memory is not necessarily provided at the remote controller. Thus, this configuration is also applicable to an existing remote controller, and therefore, a cost increase can be prevented.

DESCRIPTION OF EMBODIMENTS

Embodiments of a remote controller setting device of the present invention will be described hereinafter in detail with reference to the drawings.

Embodiment 1

Figure 1:
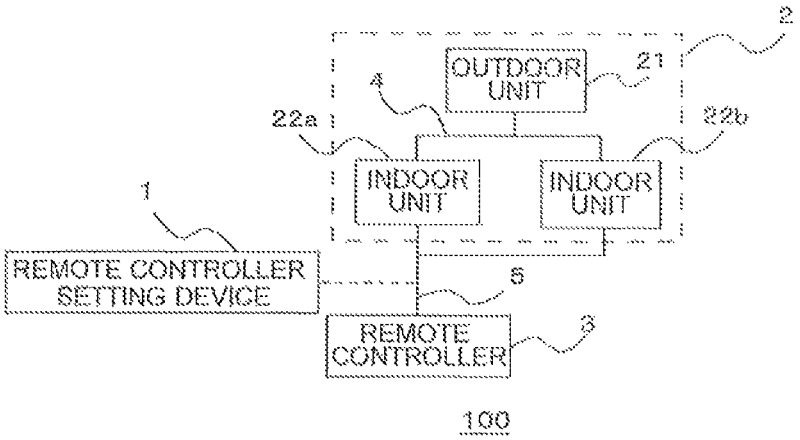
FIG. 1 is a diagram of an air-conditioning system including a remote controller setting device in Embodiment 1.

FIG. 1 is a view of an air-conditioning system 100 including a remote controller setting device 1 in Embodiment 1. As illustrated in FIG. 1, the air-conditioning system 100 includes an air-conditioning device 2 with an outdoor unit 21, an indoor unit 22*a*, and an indoor unit 22*b* forming a refrigerant circuit; a remote controller 3 configured to operate the air-conditioning device 2; and the remote controller setting device 1 configured to set the remote controller 3. The outdoor unit 21, the indoor unit 22*a*, and the indoor unit 22*b* are connected together via an air-conditioning apparatus communication line 4. Moreover, the indoor unit 22*a* and the indoor unit 22*b* are connected to the remote controller 3 via a remote controller communication line 5. Further, the remote controller setting device 1 is connected to the remote controller communication line 5. Note that the remote controller setting device 1 is connected to the remote controller communication line 5 only in setting of the remote controller 3, and is not connected in normal operation of the air-conditioning device 2. The setting of the remote controller 3 is performed in installation or setting change of the remote controller 3, for example.

The outdoor unit 21 is disposed outside a room to be air-conditioned, and is configured to supply the indoor units 22*a*, 22*b* with heating energy or cooling energy. The indoor units 22*a*, 22*b* are arranged in the room to be air-conditioned, and are configured to receive the heating energy or the cooling energy supplied from the outdoor unit 21 to perform heating or cooling in the room. The remote controller 3 is placed on, e.g., a wall of the room to be air-conditioned, and is configured to transmit, based on operation by a user, a control command to the air-conditioning device 2 via the remote controller communication line 5.

The remote controller 3 and the indoor units 22*a*, 22*b* regularly communicate with each other (hereinafter referred to as "regular communication") at regular intervals (e.g., an interval of 10 seconds), thereby checking their operation statuses and presences. In the regular communication, monitoring transmission from the remote controller 3 to the indoor units 22*a*, 22*b* is regularly performed in a state in which the remote controller 3 is not operated by the user. In response, a main one of the indoor units 22*a*, 22*b* responds to the remote controller 3 with the operation statuses etc. In a case where the remote controller 3 is operated by the user, the remote controller 3 transmits the control command to the indoor units 22*a*, 22*b* without waiting for the regular communication. Note that monitoring transmission and control command transmission from the remote controller 3 and response transmission from the indoor unit 22*a*, 22*b* inevitably begin after it is confirmed that the remote controller communication line 5 is in a non-communication state. In a case where other communication is being established, a standby state continues until the remote controller communication line 5 goes into the non-communication state, and it is determined again whether the remote controller communication line 5 is in the non-communication state before the transmissions begin.

Of the setting contents for the remote controller 3, the setting contents stored in the remote controller 3 are set by the remote controller setting device 1. The setting contents stored in the remote controller 3 include, for example, the following items:

(1) settings of time and operation for a weekly schedule automatically controlled in every day of the week, such as start-stop, modes, and temperature settings;

(2) settings of time and operation for an ON-OFF timer configured for operation or stoppage at specified time;

(3) time settings of an automatic OFF timer configured for automatic stoppage after a lapse of a certain period of time from the start of operation;

(4) display settings of a temperature unit such as Fahrenheit or Celsius;

(5) 12-hour or 24-hour display settings of time; and (6) contrast settings for adjusting a liquid crystal display intensity.

Figure 2:
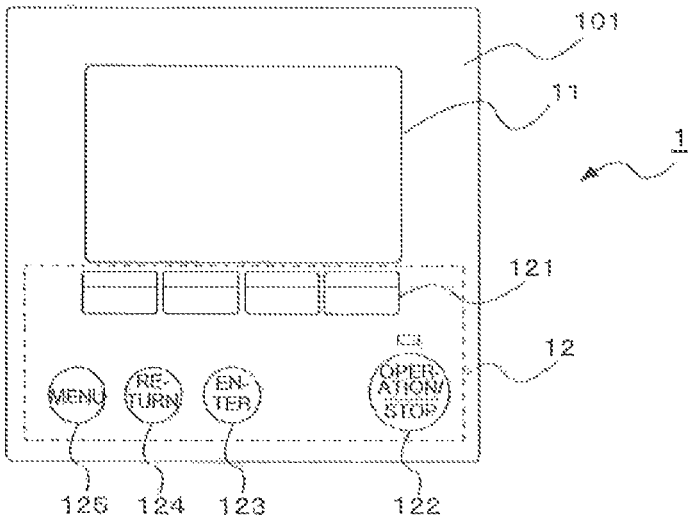
FIG. 2 is a front view of the remote controller setting device in Embodiment 1.
Figure 3:
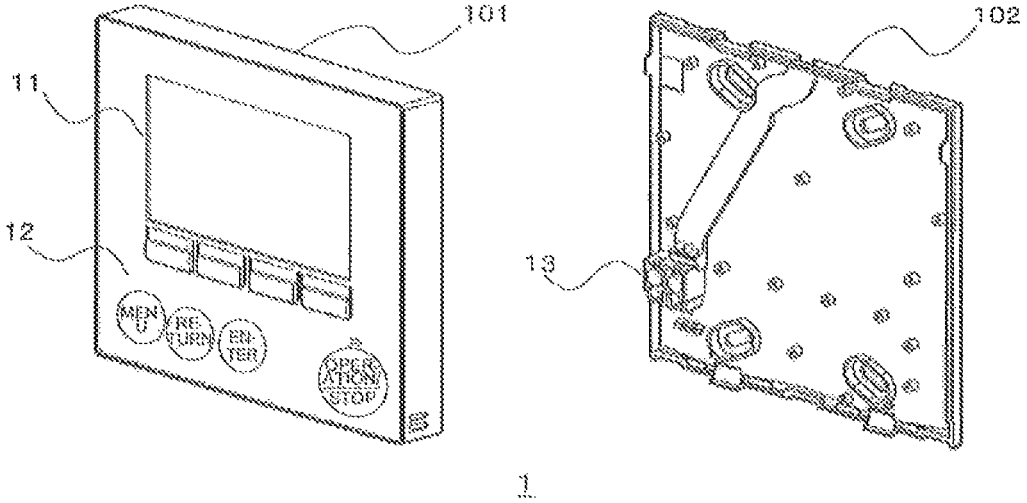
FIG. 3 is an exploded perspective view of the remote controller setting device in Embodiment 1.

FIG. 2 is a front view of the remote controller setting device 1 of the present embodiment, and FIG. 3 is an exploded perspective view of the remote controller setting device 1 in the present embodiment. Note that the remote controller setting device 1 of the present embodiment has the same hardware configuration as that of the remote controller 3, and a front view and an exploded perspective view of the remote controller 3 are the same as those of FIGS. 2 and 3.

As illustrated in FIG. 3, the remote controller setting device 1 includes a front portion 101 and a back portion 102. Moreover, as illustrated in FIGS. 2 and 3, the front portion 101 is provided with a display unit 11 and an operation unit 12. The display unit 11 includes, for example, a liquid crystal display, and is configured to display the setting contents set by the remote controller setting device 1 and the progress of setting processing described later, for example. The operation unit 12 has a plurality of function keys 121 corresponding respectively to a plurality of functions or settings, and a plurality of fixed keys corresponding respectively to unique functions. The fixed keys include an operation/stop key 122, an enter key 123, a return key 124, and a menu key 125. Each key of the operation unit 12 includes a pressing button switch.

As illustrated in FIG. 3, the back portion 102 is provided with a terminal block 13 for connection to the remote controller communication line 5. In the present embodiment, the terminal block 13 of the remote controller setting device 1 and a terminal block of the remote controller 3 connected to the remote controller communication line 5 are connected together via a wire by, e.g., an alligator clip or terminal block joint-fastening, and therefore, the remote controller setting device 1 is connected to the remote controller communication line 5. Note that a wire with the alligator clip may be connected to the terminal block 13 of the remote controller setting device 1 in advance, and therefore, it is not necessary to disassemble the front portion 101 and the back portion 102 from each other every time connection is made. Alternatively, the terminal block 13 of the remote controller setting device 1 may be, by an alligator clip or terminal block joint-fastening, connected to each terminal block of the indoor units 22*a*, 22*b* connected to the remote controller communication line 5, and therefore, the remote controller setting device 1 may be connected to the remote controller communication line 5. Moreover, not only does the remote controller setting device 1 communicate with the remote controller 3 via the remote controller communication line 5, but also it is operated by receiving, via the terminal block 13, power superimposed on the remote controller communication line 5. Note that as long as the power has the same voltage as the voltage superimposed on the remote controller communication line 5, the remote controller setting device 1 can be operated using typical power as a substitution.

Figure 4:
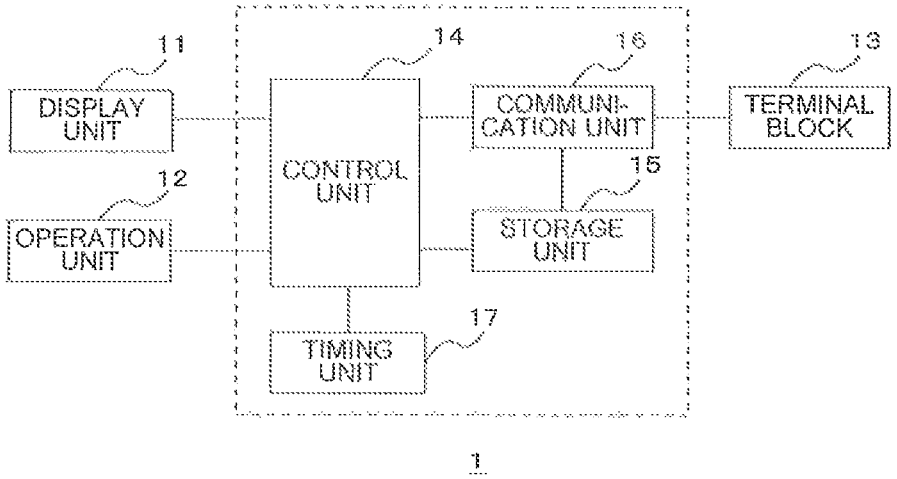
FIG. 4 is a diagram of a control configuration of the remote controller setting device in Embodiment 1.

FIG. 4 is a view of a control configuration of the remote controller setting device 1 of the present embodiment. Note that the control configuration of the remote controller setting device 1 is a portion surrounded by a dashed line of FIG. 4. As illustrated in FIG. 4, the remote controller setting device 1 includes a control unit 14 configured to control each unit of the remote controller setting device 1, a storage unit 15 configured to store various types of data and programs including setting data of the remote controller 3, a communication unit 16 configured to communicate with the remote controller 3 via the terminal block 13, and a timing unit 17 configured to measure time.

The control unit 14 includes a microcomputer etc., and identifies operation contents input via the operation unit 12 to perform processing according to the operation contents. Specifically, the control unit 14 switches an indication on the display unit 11 according to the operation contents input via the operation unit 12. Moreover, in a case where setting data on the setting contents of the remote controller 3 is input via the operation unit 12, the input setting data is stored in the storage unit 15. Further, in a case where a setting data transmission instruction or a setting data transmission cancelling instruction is input via the operation unit 12, the control unit 14 instructs the communication unit 16 to start or cancel the setting processing.

The storage unit 15 includes a non-volatile memory, and is configured to store the setting data input via the operation unit 12.

The communication unit 16 is configured to perform the setting processing for the remote controller 3 according to the instruction from the control unit 14. In the setting processing, the setting data of the remote controller 3 is read from the storage unit 15, and is transmitted to the remote controller communication line 5 via the terminal block 13. Moreover, the communication unit 16 receives communication via the remote controller communication line 5, and transmits such communication to the control unit 14.

Figures 5, 6:
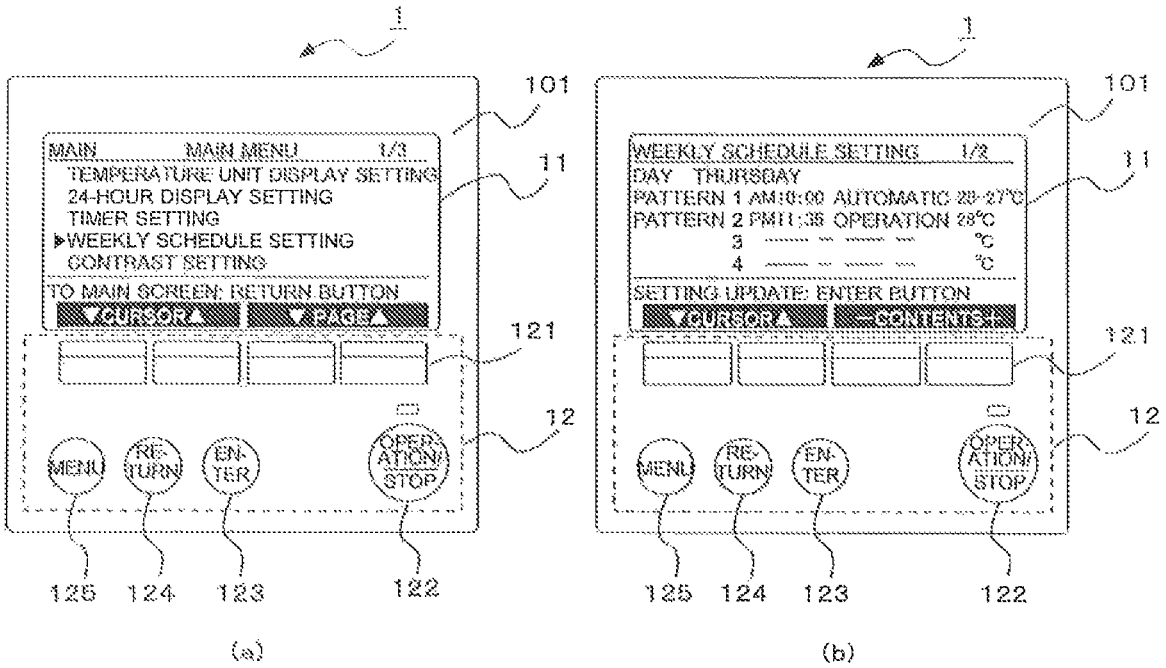
FIG. 5 is a view of a display example of the remote controller setting device upon setting of a weekly schedule in Embodiment 1.
FIG. 6 shows an example of a weekly schedule set by the remote controller setting device in Embodiment 1.

Next, operation of the remote controller setting device 1 will be described. The case of inputting the weekly schedule will be described as an example of input of the setting data in the remote controller setting device 1. FIG. 5 is a view of a display example of the remote controller setting device 1 when the weekly schedule is set. First, when the menu key 125 of the remote controller setting device 1 is pressed, the control unit 14 causes the display unit 11 to display a menu screen illustrated in FIG. 5(*a*). The setting contents of the remote controller 3 settable in the remote controller setting device 1 are displayed on the menu screen. Then, the setting contents are selected using the function keys 121. When the enter key 123 is pressed, a setting target is determined. At this point, in the case of selecting a "WEEKLY SCHEDULE" item, the control unit 14 displays, on the display unit 11, the contents of the weekly schedule as illustrated in FIG. 5(*b*). Then, the user (an operator) operates, e.g., the function keys 121 and the enter key 123, thereby inputting the weekly schedule of the remote controller 3. Subsequently, when the enter key 123 is pressed after completion of input, the control unit 14 stores, in the storage unit 15, the input setting contents as the setting data.

FIG. 6 illustrates an example of the weekly schedule set by the remote controller setting device 1. As illustrated in FIG. 6, an operation mode, start-stop, and a set temperature are set for each point of time in every day of the week in the weekly schedule. The set data is stored in the storage unit 15.

Note that the remote controller setting device 1 has, as described above, the same hardware configuration as that of the remote controller 3, and the method for inputting the setting contents of the remote controller 3 is the same as the method for inputting the setting contents of the remote controller setting device 1. With this configuration, the setting can be input in the remote controller setting device 1 without learning special operation. Further, according to an on-site situation, the setting contents can be changed flexibly. Note that in the remote controller 3 and the remote controller setting device 1, a room temperature setting, the operation mode such as cooling or heating, a wind direction, a wind velocity, etc. can be input to the indoor units 22*a*, 22*b* to control the air-conditioning device 2.

Figure 7:
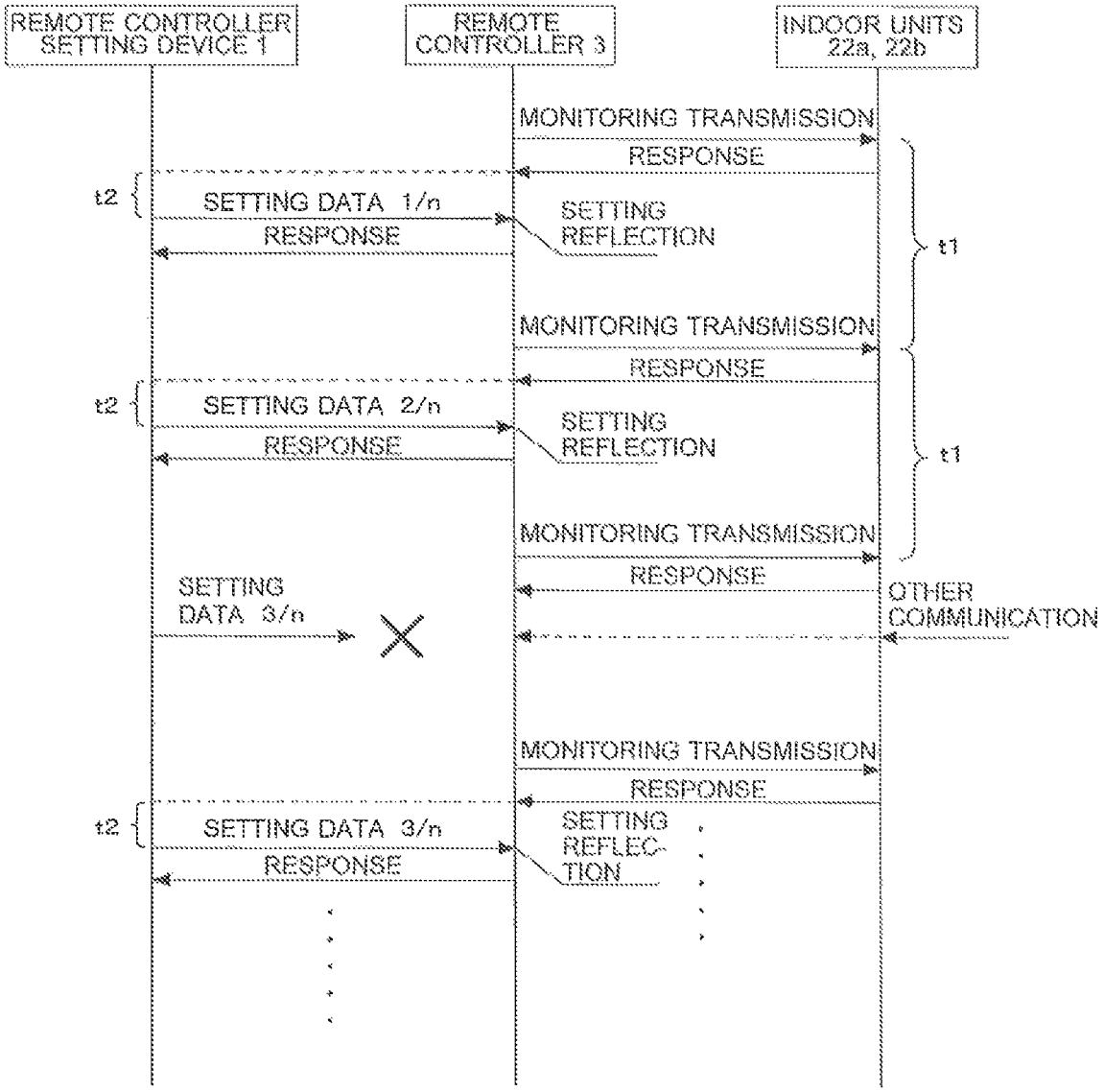
FIG. 7 is a chart for describing setting processing in Embodiment 1.

Next, the setting processing of the remote controller 3 in the remote controller setting device 1 will be described. FIG. 7 is a chart for describing the setting processing in the present embodiment. In the present embodiment, in a case where the user instructs transmission of the setting data via the operation unit 12, the setting processing is started by the communication unit 16. Transmission of the setting data is instructed in such a manner that the function key 121 corresponding to "TRANSMIT" displayed on the display unit 11 is operated, for example. The communication unit 16 divides the setting data stored in the storage unit 15 by n, and transmits the divided pieces of setting data in the interval of the regular communication among the remote controller 3 and the indoor units 22*a*, 22*b*. The communication unit 16 monitors the remote controller communication line 5 to determine whether or not the regular communication is performed. As illustrated in FIG. 7, in a case where the remote controller 3 and the indoor units 22*a*, 22*b* perform the regular communication at time intervals t1, when predetermined time period t2 is elapsed after reception of the response in the regular communication, the communication unit 16 transmits part (1/n) of the setting data to the remote controller communication line 5. The predetermined time period t2 is measured by the timing unit 17.

Since the setting data is transmitted after a lapse of the predetermined time period t2 from the response in the regular communication, other communication can be performed within the time period t2. In a case where other communication is being established on the remote controller communication line 5, the communication unit 16 does not transmit the setting data even after the regular communication. This can prevent interference with other communication. Other communication indicates, for example, communication from a system controller (not shown) configured to manage the entirety of the air-conditioning device 2 included in the air-conditioning system 100.

In the regular communication, the remote controller 3 changes the indication etc. according to the response from the indoor unit 22*a*, 22*b*. Moreover, the remote controller 3 receives the setting data transmitted from the remote controller setting device 1 to the remote controller communication line 5, and reflects such data in settings of this unit itself. Then, the remote controller 3 responds to the remote controller setting device 1 that the setting data is received.

Figure 8:
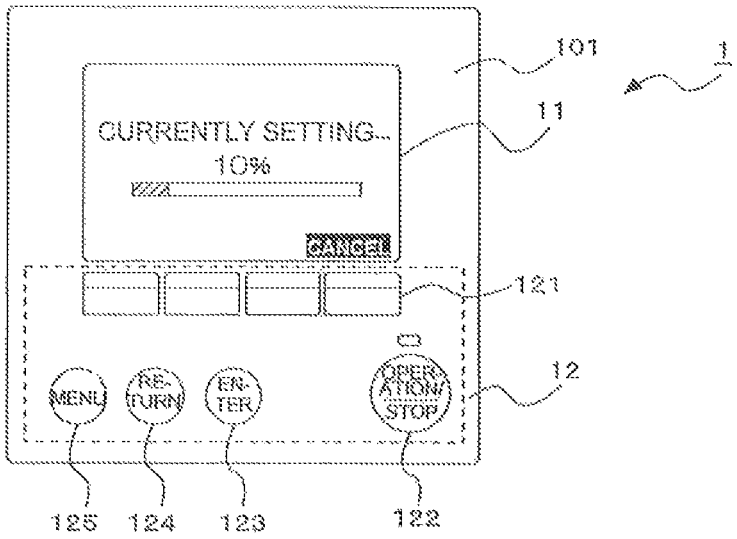
FIG. 8 is a view of a display example of the progress of the setting processing in Embodiment 1.

Moreover, the control unit 14 of the remote controller setting device 1 displays the progress of setting processing on the display unit 11. FIG. 8 is a view of a display example of the progress of setting processing in the present embodiment. As illustrated in FIG. 8, the display unit 11 displays that the remote controller 3 is being set, as well as displaying the progress of setting processing. The progress of setting processing is displayed in percentage based on the percentage of the setting data having been already transmitted in the setting data stored in the storage unit 15. By such displaying, the user can check the progress of setting processing, and can retrieve the remote controller setting device 1 at proper timing. The indication of the progress is not limited to above, and the quantity of setting data having been already set and the total quantity of setting data may be displayed in the form of a fraction.

Further, the communication unit 16 cancels the setting processing when cancellation of the setting processing is instructed in the middle of the setting processing. For example, in the display example illustrated in FIG. 8, cancellation of the setting processing is instructed in such a manner that the function key 121 corresponding to a "CANCEL" indication of the display unit 11 is operated.

Figure 9:
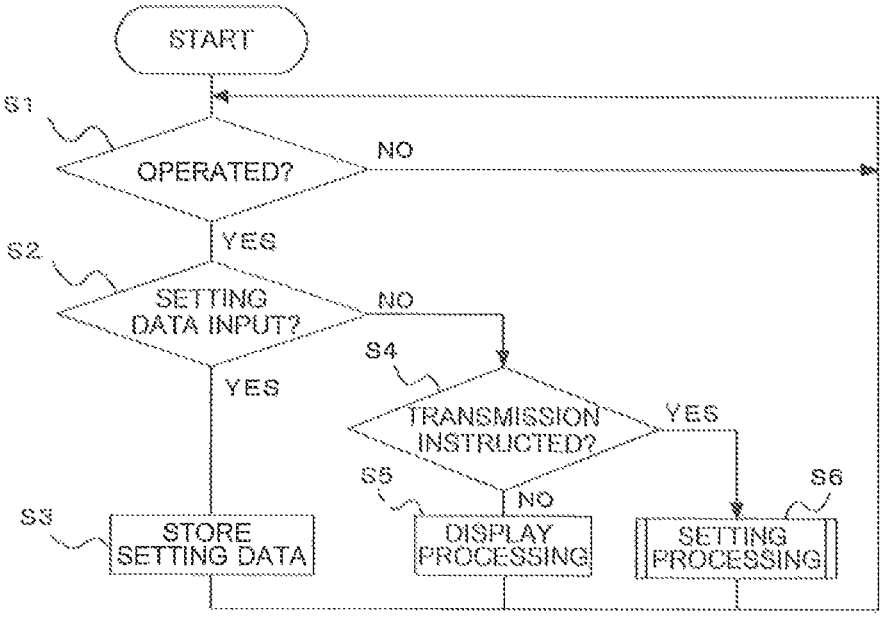
FIG. 9 is a flowchart of operation in the remote controller setting device of Embodiment 1.

FIG. 9 is a flowchart of operation of the remote controller setting device 1 of the present embodiment. The present processing begins when the remote controller setting device 1 is connected to the remote controller communication line 5 and the remote controller setting device 1 is powered ON, and ends when the remote controller setting device 1 is powered OFF. In the present processing, it is first determined whether or not the operation unit 12 is operated (S1). Then, in a case where the operation unit 12 is not operated (S1: NO), the standby state is maintained until the operation unit 12 is operated. On the other hand, in a case where the operation unit 12 is operated (S1: YES), it is determined whether or not the operation contents indicate input of the setting data (S2). At this step, in a case where the operation of newly performing setting or the operation of changing the settings is performed, it is determined that the operation contents indicate input of the setting data.

Then, in a case where the operation contents indicate input of the setting data (S2: YES), the input setting data is stored in the storage unit 15 (S3). On the other hand, in a case where the operation contents do not indicate input of the setting data (S2: NO), it is determined whether or not the operation contents indicate the instruction of transmitting the setting data (S4). Then, in a case where the operation contents do not indicate the instruction of transmitting the setting data (S4: NO), the processing of changing the indication on the display unit 11 according to the operation contents is performed (S5). On the other hand, in a case where the operation contents indicate the instruction of transmitting the setting data (S4: YES), the setting processing for the remote controller 3 begins (S6).

Figure 10:
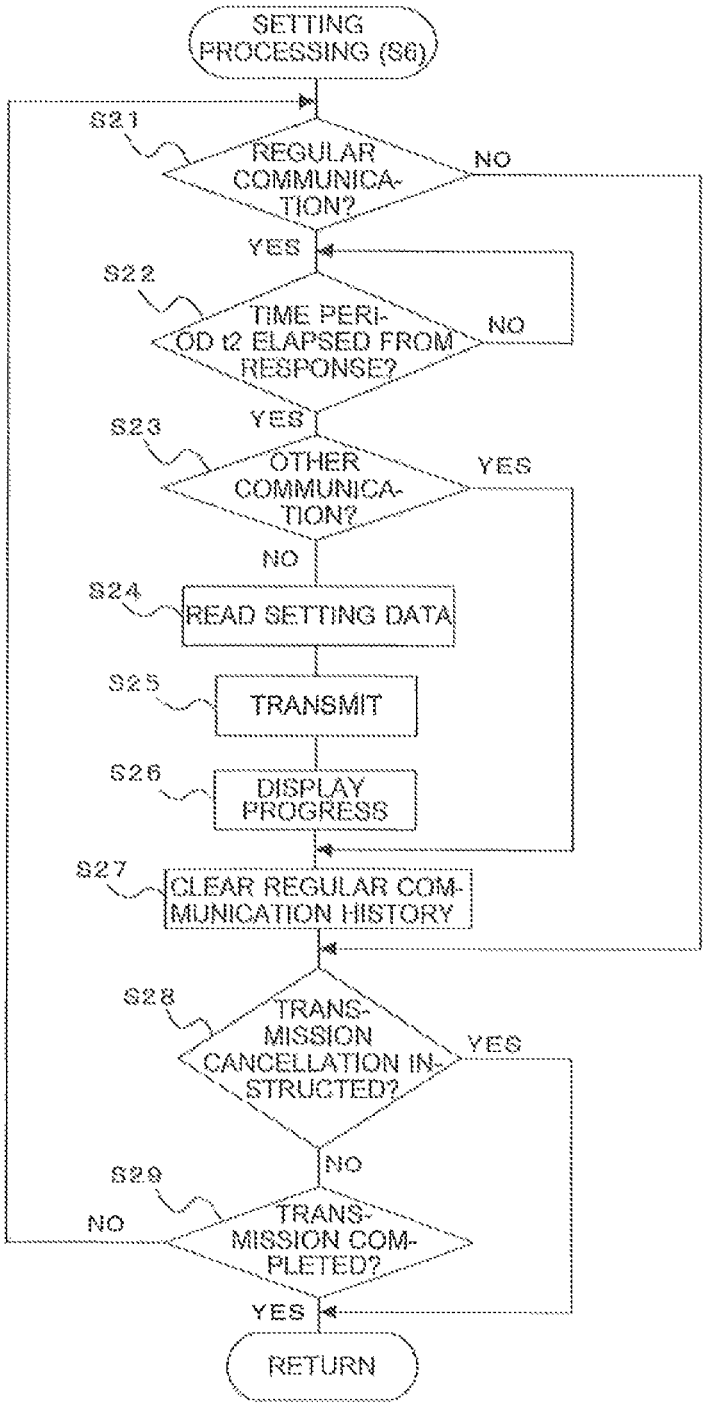
FIG. 10 is a flowchart of the setting processing in Embodiment 1.

FIG. 10 is a flowchart of the setting processing in the present embodiment. In the present processing, it is first determined whether or not the regular communication is being established on the remote controller communication line 5 (S21). At this step, in a case where the regular communication is not made (S21: NO), the processing proceeds to a step S28. On the other hand, in a case where the regular communication is being established (S21: YES), time from the point of detection of the response in the regular communication is measured by the timing unit 17, and it is determined whether or not the predetermined time period t2 is elapsed after the response in the regular communication (S22). Then, in a case where the predetermined time period t2 is not elapsed after the response in the regular communication (S22: NO), the standby state is maintained until the predetermined time period t2 is elapsed.

On the other hand, in a case where the predetermined time period t2 is elapsed after the response in the regular communication (S22: YES), it is determined whether or not other communication is being established on the remote controller communication line 5 (S23). Then, in a case where other communication is being established (S23: YES), the processing proceeds to a step S27. On the other hand, in a case where other communication is not made (S23: NO), non-transmitted setting data is read from the storage unit 15 (S24), and then, is transmitted to the remote controller communication line 5 (S25). Then, the progress is displayed on the display unit 11 as illustrated in FIG. 8 (S26).

Then, the history of the regular communication is cleared (S27). Thus, transmission of the setting data between the regular communication and the subsequent regular communication is limited to zero in the case of colliding with other communication, and is limited to one in the case where no other communication is being established. Next, it is determined whether or not the instruction of cancelling transmission is made via the operation unit 12 (S28). Then, in a case where the instruction of cancelling transmission is made (S28: YES), the setting processing is terminated. On the other hand in a case where the instruction of cancelling transmission is not made (S28: NO), it is determined whether or not transmission has been completed (S29). At this step, it is determined whether or not transmission of all pieces of the setting data stored in the storage unit 15 has been completed. Then, in a case where transmission has not been completed yet (S29: NO), the processing returns to the step S21 to repeat the processing subsequent to the step S21. On the other hand, in a case where transmission has been completed (S29: YES), the setting processing is terminated. After termination of the setting processing, the processing returns to the step S1 of FIG. 9 to repeat the processing subsequent to the step S1.

As described above, according to the present embodiment, the remote controller 3 can be automatically set by the remote controller setting device 1, and therefore, setting process burden can be reduced. Moreover, the remote controller setting device 1 has the same hardware configuration as that of the remote controller 3, and therefore, a cost increase can be prevented.

Moreover, the communication unit 16 transmits the setting data in multiple pieces in the interval of the regular communication between the remote controller 3 and the air-conditioning device 2. With this configuration, the remote controller 3 can be kept operating normally, i.e., operation of the remote controller 3 is not limited, while the process of setting the remote controller 3 is performed. Further, in a case where other communication is being established on the remote controller communication line 5, the communication unit 16 stops transmission of the setting data. This prevents interference with other communication.

In addition, the remote controller setting device 1 includes the operation unit 12 to which the setting data is input, and therefore, the setting data can be input according to the on-site situation etc. Moreover, the operation unit 12 has the same configuration as that of an operation unit of the remote controller 3, and therefore, the setting operation is facilitated. This leads to shortening of working time. Further, the progress of transmission of the setting data is displayed on the display unit 11, and therefore, the timing of retrieving the remote controller setting device 1 can be noticeable by the user.

Embodiment 2

Next, Embodiment 2 of the present invention will be described. A remote controller setting device 1 of Embodiment 2 is different from Embodiment 1 in the timing of starting setting processing. The configuration of the remote controller setting device 1 and the flow of the setting processing are similar to those of Embodiment 1, and the same reference numerals will be used.

In Embodiment 1, the setting processing (S6) begins with the user's instruction of transmitting the setting data as a trigger. However, it tends to avoid execution of the setting process during the operation of the air-conditioning device 2, and it is convenient if the setting processing can begin at time of stoppage of the air-conditioning device 2. Thus, in the present embodiment, the timing of starting the setting processing is input via an operation unit 12, and the setting processing begins at the input timing.

Figure 11:
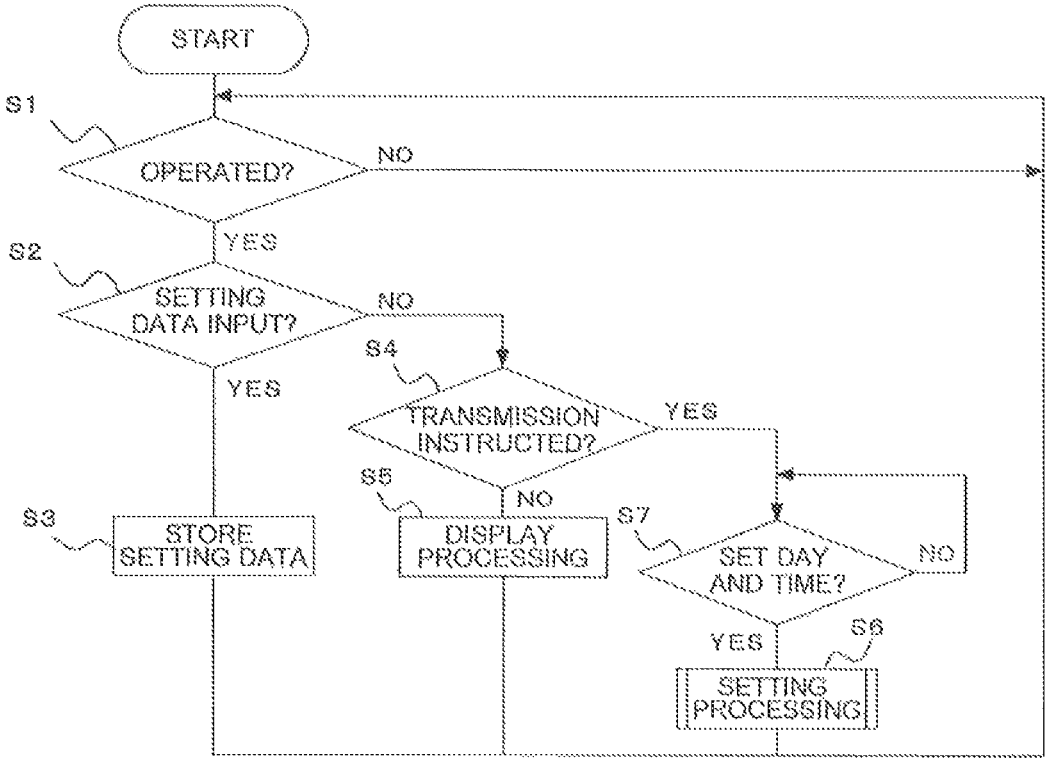
FIG. 11 is a flowchart of an example of operation in a remote controller setting device of Embodiment 2.

FIG. 11 is a flowchart of an example of operation of the remote controller setting device 1 of the present embodiment. In FIG. 11, the same reference numerals as those of Embodiment 1 are used to represent equivalent processing. In the example of FIG. 11, the setting processing is performed according to a schedule including day and time. A user sets, via the operation unit 12, the day and time of starting the setting processing, and at the set day and time, the setting processing begins. Specifically, steps S1 to S5 similar to those of Embodiment 1 are first performed. Then, in a case where operation contents indicate the instruction of transmitting setting data (S4: YES), it is determined whether or not day and time reach the set day and time (S7). Then, in a case where the day and time do not reach the set day and time (S7: NO), a standby state is maintained until the set day and time. On the other hand, in a case where the day and time reach the set day and time (S7: YES), the setting processing is performed for a remote controller 3 (S6). Note that at this step, the day and time of starting the setting processing are not limited to the case of setting by the user, and such day and time may be set to fixed time (e.g., 0:00) in advance. Alternatively, only either one of the day or the time may be set.

Figure 12:
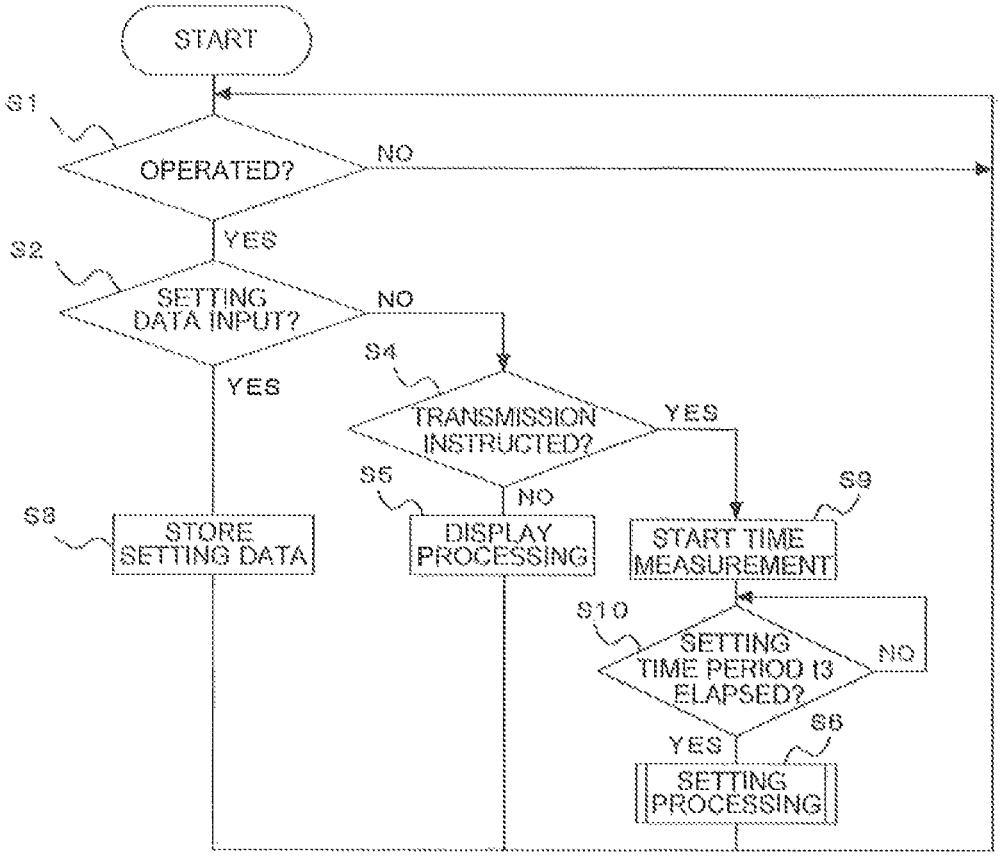
FIG. 12 is a flowchart of another example of operation in the remote controller setting device of Embodiment 2.

Moreover, FIG. 12 is a flowchart of another example of operation in the remote controller setting device 1 of the present embodiment. In FIG. 12, the same reference numerals as those of Embodiment 1 are used to represent equivalent processing. In the example of FIG. 12, set time period t3 is input via the operation unit 12, and the setting processing begins after a lapse of the set time period t3. Specifically, the steps S1 to S5 similar to those of Embodiment 1 are performed. Then, in a case where the operation contents indicate the instruction of transmitting the setting data (S4: YES), time measurement by the timing unit 17 begins (S9). Then, it is determined whether or not the set time period t3 has been elapsed (S10). In a case where the set time period t3 has not been elapsed yet (S10: NO), the standby state is maintained until the set time period t3 is elapsed. On the other hand, in a case where the set time period t3 has been elapsed (S10: YES), the setting processing is performed for the remote controller 3 (S6).

As described above, according to the present embodiment, the setting processing can begin at the day and time set as the schedule or after a lapse of the set time period t3. Thus, it is not necessary for the user to be tied up in setting, which leads to improvement of workability. Moreover, the time period of stopping an air-conditioning device 2 or the day without other processes is set as the time of starting the setting processing, and therefore, a setting process can be performed for the remote controller 3 without interference with test operation such as checking of communication.

Embodiment 3

Next, Embodiment 3 of the present invention will be described. A remote controller setting device 1A of Embodiment 3 is different from that of Embodiment 1 in that setting data is read from an external memory 6. Other configurations of the remote controller setting device 1A and the flow of setting processing are similar to those of embodiment 1, and the same reference numerals will be used.

Figure 13:
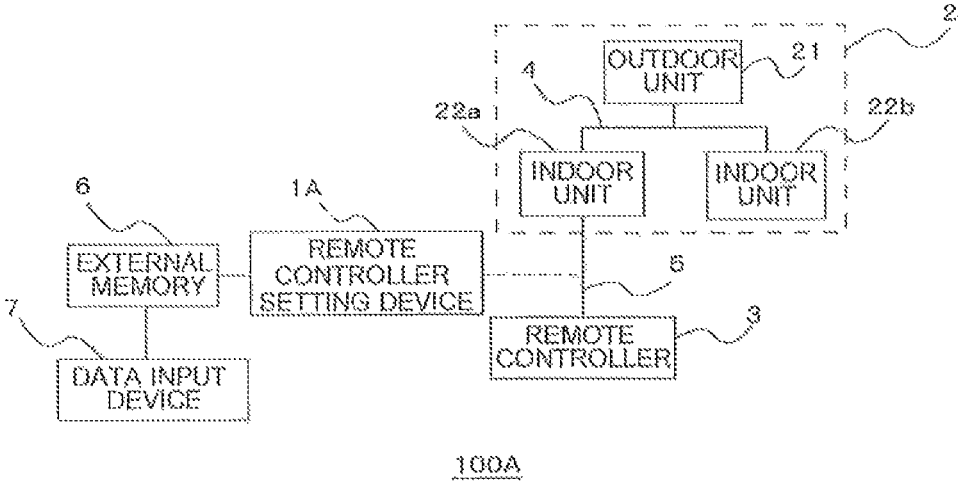
FIG. 13 is a diagram of an air-conditioning system including a remote controller setting device in Embodiment 3.

FIG. 13 is a diagram of an air-conditioning system 100A including the remote controller setting device 1A of the present embodiment. The air-conditioning system 100A of the present embodiment further includes the external memory 6 configured to store setting data on setting contents of a remote controller 3, and a data input device 7 configured to input the setting data to the external memory 6. The external memory 6 is a memory card such as a SD card, or an external storage medium device equipped with a non-volatile memory, such as a USB memory. The external memory 6 is inserted into the remote controller setting device 1A so that the stored setting data can be read into the remote controller setting device 1A.

The data input device 7 is a terminal device such as a personal computer, and is configured to write the data into the external memory 6, read the data, and edit the data. In this case, e.g., dedicated software for inputting the setting contents of the remote controller 3 is installed in the data input device 7, and the setting contents of the remote controller 3 are input using the software. Note that the setting contents of the remote controller 3 input at the data input device 7 are the same as those set at the remote controller setting device 1 of Embodiment 1. Note that input of the setting contents of the remote controller 3 is not limited to the case of using the dedicated software, and versatile software for creating a CSV file may be used, for example.

In a case where input of the setting data is completed in the data input device 7, the external memory 6 is inserted into the data input device 7, and the setting data input to the external memory 6 is written. As long as the format of the data written in the external memory 6 is a format readable by the remote controller setting device 1, such a format may be a versatile format such as a CSV format or a dedicated format.

Figure 14:
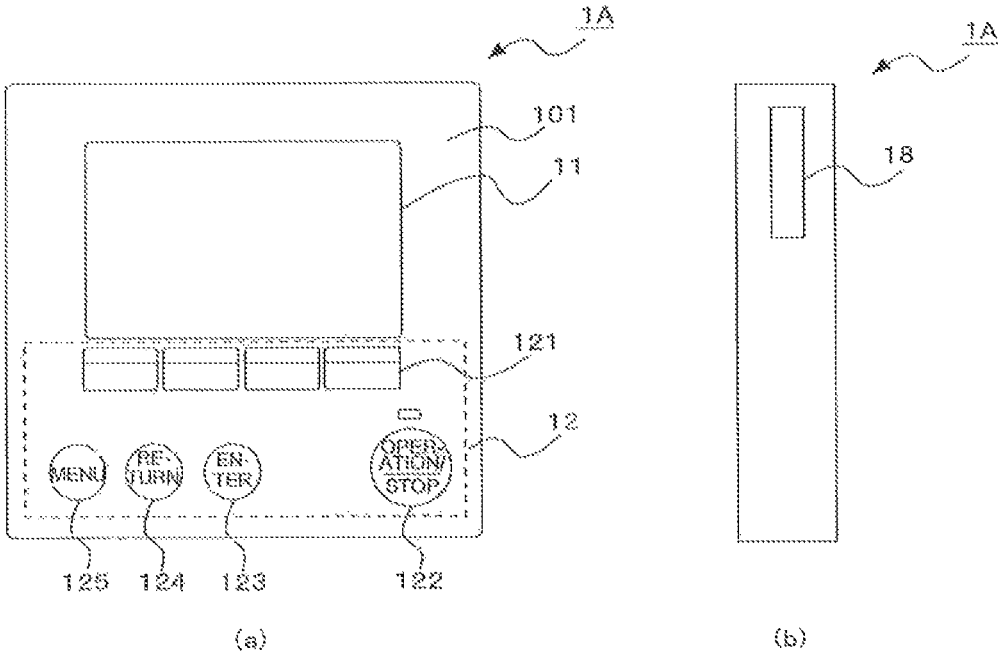
FIG. 14 is a view of an outer appearance of the remote controller setting device in Embodiment 3.

FIG. 14 is a view of an outer appearance of the remote controller setting device 1A of the present embodiment. FIG. 14(*a*) is a front view of the remote controller setting device 1A, and FIG. 14(*b*) is a side view of the remote controller setting device 1A. As illustrated in FIG. 14(*b*), a side surface of the remote controller setting device 1A is provided with an external memory insertion unit 18 into which the external memory 6 is inserted. Other configurations of the remote controller setting device 1A are similar to those of Embodiment 1.

Figure 15:
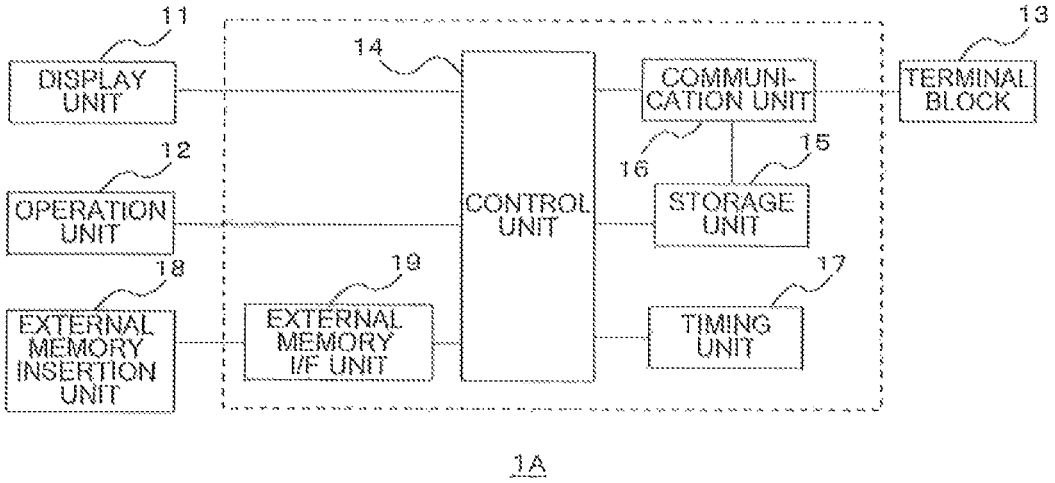
FIG. 15 is a diagram of a control configuration of the remote controller setting device in Embodiment 3.

FIG. 15 is a diagram of a control configuration of the remote controller setting device 1A of the present embodiment. Note that the control configuration of the remote controller setting device 1A is a portion surrounded by a dashed line of FIG. 15. As illustrated in FIG. 15, the remote controller setting device 1A further includes an external memory interface unit 19 (hereinafter referred to as an "external memory I/F unit 19"). Other configurations are similar to those of Embodiment 1. The external memory I/F unit 19 is an interface configured to read the setting contents stored in the external memory 6 inserted into the external memory insertion unit 18. A control unit 14 is configured to store, in a storage unit 15, the setting data read by the external memory I/F unit 19.

Figure 16:
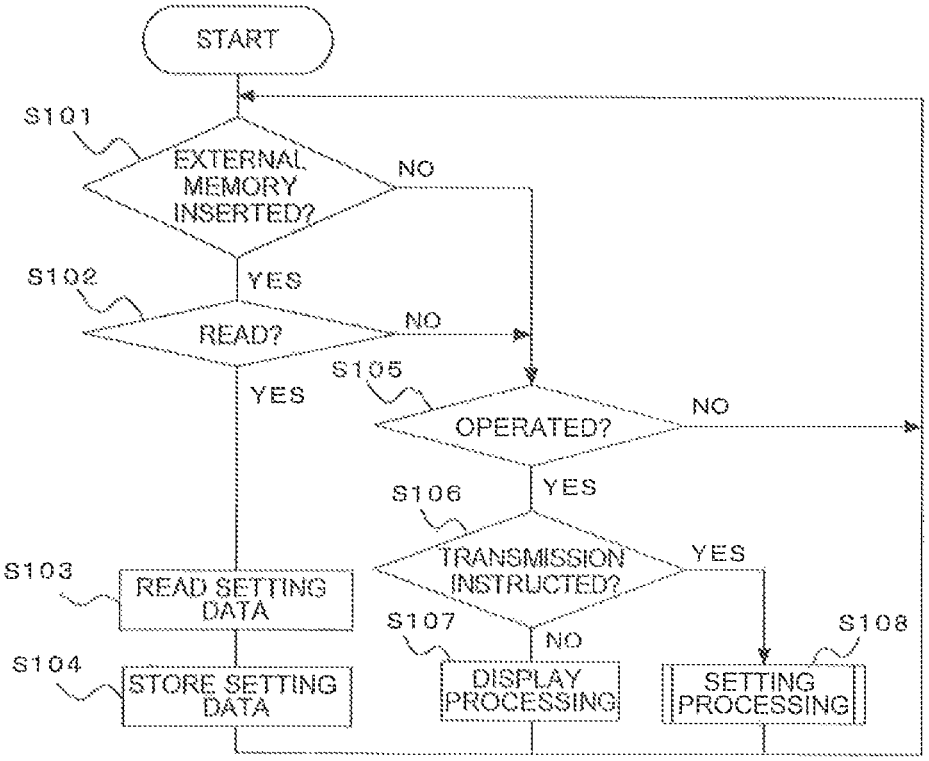
FIG. 16 is a flowchart of operation in the remote controller setting device of Embodiment 3.

FIG. 16 is a flowchart of operation in the remote controller setting device 1A of the present embodiment. In the present processing, it is first determined whether or not the external memory 6 is inserted into the external memory insertion unit 18 (S101). Then, in a case where the external memory 6 is inserted into the external memory insertion unit 18 (S101: YES), it is determined whether or not the setting data is to be read from the external memory 6 (S102). At this step, the indication of prompting selection on whether or not the setting data stored in the external memory 6 is read into the remote controller setting device 1A is displayed on a display unit 11, and therefore, a user can make selection. Then, in a case where the user selects to read the setting data from the external memory 6 (S102: YES), the setting data is read from the external memory 6 (S103), and then, is stored in the storage unit 15 (S104).

On the other hand, in a case where the external memory 6 is not inserted into the external memory insertion unit 18 (S101: NO) or the user selects not to read the data from the external memory 6 into the remote controller setting device 1A (S102: NO), it is determined whether or not an operation unit 12 is operated (S105). Then, in a case where the operation unit 12 is not operated (S105: NO), the processing returns to S101, and the processing subsequent to S101 is repeated. On the other hand, in a case where the operation unit 12 is operated (S105: YES), it is determined whether or not operation contents indicate the instruction of transmitting the setting data (S106). Then, in a case where the operation contents do not indicate the instruction of transmitting the setting data (S106: NO), the processing of displaying on the display unit 11 is performed according to the operation contents (S107). On the other hand, in a case where the operation contents indicate the instruction of transmitting the setting contents (S106: YES), the setting processing is performed for the remote controller 3 (S108).

As described above, according to the present embodiment, the setting data of the remote controller 3 input or edited using the data input device 7 such as the personal computer is written into the external memory 6, and is read from the external memory 6 into the remote controller setting device 1A. Thus, a setting process can be facilitated, and setting process time can be shortened.

Embodiment 4

Next, Embodiment 4 of the present invention will be described. A remote controller setting device 1 of Embodiment 4 is different from that of Embodiment 1 in the timing of transmitting setting data in setting processing. The configuration of the remote controller setting device 1 is similar to that of embodiment 1, and the same reference numerals will be used.

Figure 17:
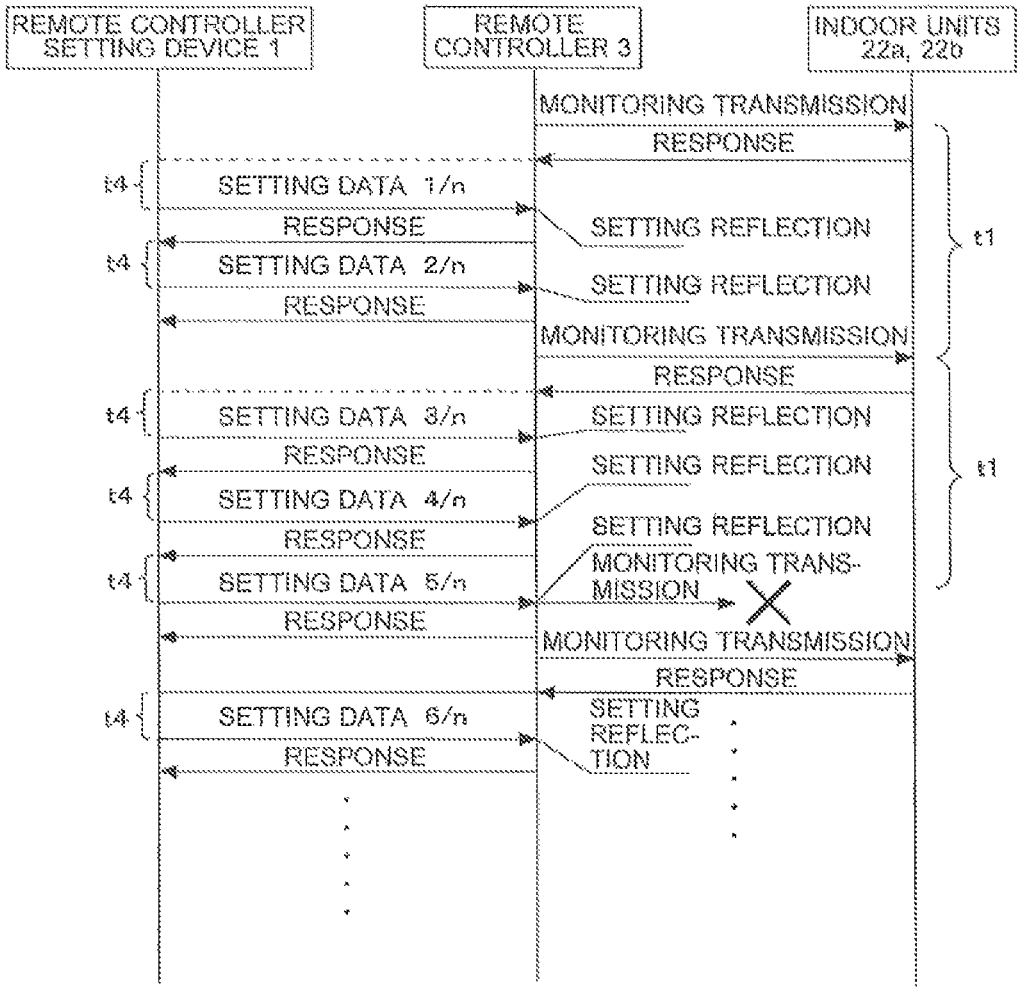
FIG. 17 is a chart for describing setting processing in Embodiment 4.

FIG. 17 is a chart for describing the setting processing in the present embodiment. In the present embodiment, the setting processing begins in a case where a user makes the instruction of transmitting the setting data via an operation unit 12 as in Embodiment 1, A communication unit 16 divides, by n, the setting data stored in a storage unit 15, and transmits the setting data to a remote controller communication line 5 at the intervals of predetermined time period t4. That is, the setting data is transmitted once in the interval of the regular communication among the remote controller 3 and the indoor units 22*a*, 22*b* in Embodiment 1, whereas the setting data is transmitted multiple times in the interval of the regular communication among a remote controller 3 and indoor units 22*a*, 22*b* as illustrated in FIG. 17 in the present embodiment.

More specifically, the communication unit 16 transmits the setting data in a case where the predetermined time period t4 is elapsed after completion of previous communication on the remote controller communication line 5. The previous communication is a response in the regular communication in the case of performing the regular communication, and is a response to the setting data in the case of transmitting the setting data. Since the setting data is transmitted after a lapse of the predetermined time period t4 as described above, other communication can be performed during such transmission. Moreover, the communication unit 16 does not transmit the setting data in a case where other communication is being established on the remote controller communication line 5. This can prevent interference with other communication.

Moreover, when receiving the setting data from the remote controller setting device 1 via the remote controller communication line 5, the remote controller 3 responds after reflecting settings of the unit itself. Further, in a case where the setting data is transmitted on the remote controller communication line 5, the regular communication is not performed even at predetermined time period t1. Then, the regular communication is performed after completion of the response to the setting data.

The present embodiment is also applicable to a communication technique of not performing the regular communication. In this case, when the predetermined time period t4 is elapsed after the previous communication, the divided n pieces of the setting data are transmitted. The previous communication is the response to the setting data in the case of transmitting the setting data and is a response communication (e.g., a response in communication between indoor units) other than communication between the remote controller setting device 1 and a setting target unit (the remote controller 3). Moreover, in a case where other communication, i.e., the response communication other than communication between the remote controller setting device 1 and the setting target unit, is made on the remote controller communication line 5, the communication unit 16 does not transmit the setting data.

Figure 18:
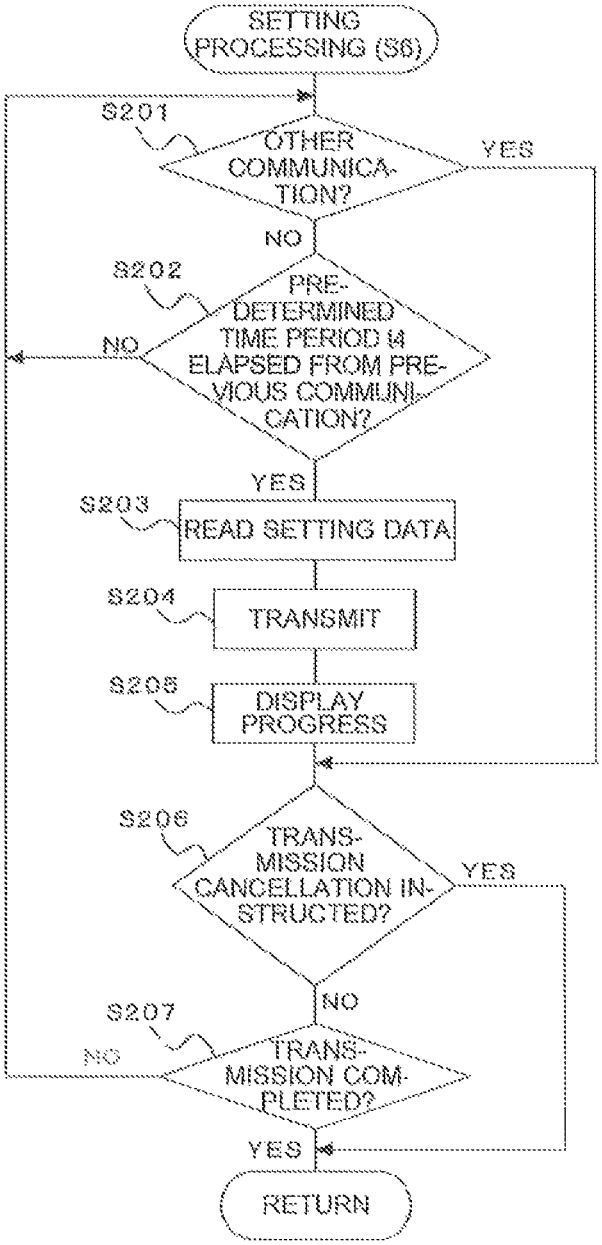
FIG. 18 is a flowchart of the setting processing in Embodiment 4.

FIG. 18 is a flowchart of the setting processing in the present embodiment. In the present processing, it is first determined whether or not other communication is being established on the remote controller communication line 5 (S201). Then, in a case where other communication is being established (S201: YES), the processing proceeds to a step S206. On the other hand, in a case where other communication is not made (S201: NO), it is determined whether or not the predetermined time period t4 is elapsed after the previous communication on the remote controller communication line 5 (S202). At this step, in a case where the predetermined time period t4 is not elapsed after the previous communication (S202: NO), the processing returns to the step S201.

On the other hand, in a case where the predetermined time period t4 is elapsed after the previous communication (S202: YES), non-transmitted setting data is read from the storage unit 15 (S203), and then, is transmitted to the remote controller communication line 5 (S204). Then, the progress similar to that of Embodiment 1 as illustrated in FIG. 8 is displayed on a display unit 11 (S205). Next, it is determined whether or not the instruction of canceling transmission is made via the operation unit 12 (S206). Then, in a case where the instruction of canceling transmission is made (S206: YES), the setting processing is terminated. On the other hand, in a case where the instruction of canceling transmission is not made (S206: NO), it is determined whether or not transmission has been completed (S207). Then, in a case where transmission has not been completed yet (S207: NO), the processing returns to the step S201, and the processing subsequent to the step S201 is repeated. On the other hand, in a case where transmission has been completed (S207: YES), i.e., a case where transmission of all pieces of the setting data stored in the storage unit 15 has been completed, the setting processing is terminated.

As described above, according to the present embodiment, setting communication is performed without interference with other communication as long as there is a moment between communications. Thus, a setting time can be shortened, and a setting process can be promptly completed.

The embodiments of the present invention have been described above, but the present invention is not limited to the configurations of the above-described embodiments. Various modifications or combinations can be made within the scope of the technical idea of the present invention. For example, in the above-described embodiments, the remote controller setting device 1 is for setting the remote controller 3 configured to operate the air-conditioning device 2, but is not limited to such a configuration. The remote controller setting device 1 may be for setting a remote controller configured to operate other refrigeration cycle devices than the air-conditioning device 2, such as a refrigerating machine and a hot-water supply device.

Figure 19:
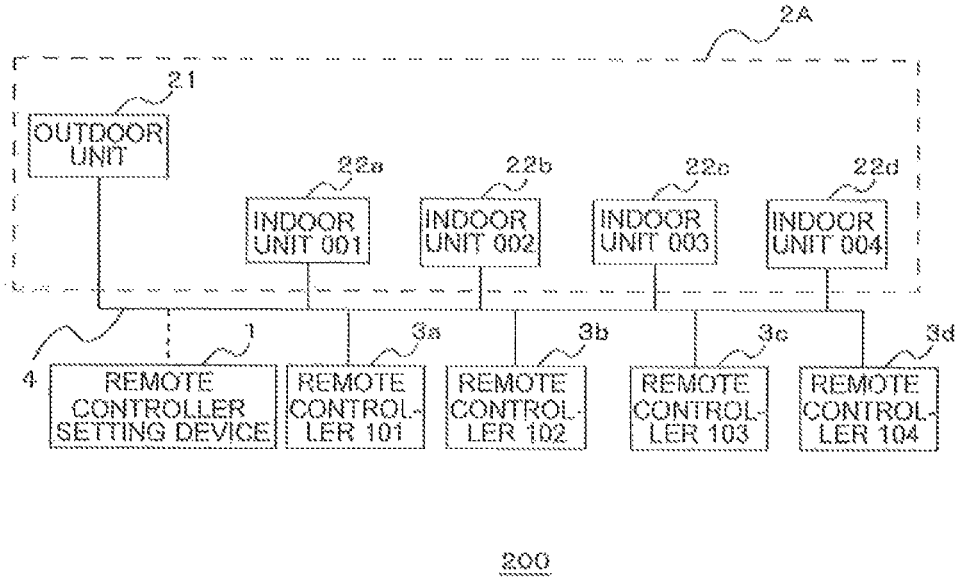
FIG. 19 is a diagram of an air-conditioning system configuration in a variation.

The air-conditioning system to which the remote controller setting device 1 is applied is not limited to the configurations of the above-described embodiments. FIG. 19 is a diagram of an air-conditioning system 200 in a variation of the present invention. In the air-conditioning system 200 illustrated in FIG. 19, an air-conditioning device 2A includes an outdoor unit 21 and indoor units 22*a*, 22*b*, 22*c*, 22*d*, and these units are connected together via an air-conditioning apparatus communication line 4. Moreover, the indoor units 22*a*, 22*b*, 22*c*, 22*d* and remote controllers 3*a*, 3*b*, 3*c*, 3*d* are connected together via the same air-conditioning apparatus communication line 4.

Each of the indoor units 22*a*, 22*b*, 22*c*, 22*d* and remote controllers 3*a*, 3*b*, 3*c*, 3*d* has a unique address. Each of the addresses of the indoor units 22*a*, 22*b*, 22*c*, 22*d* targeted for operation is set from a corresponding one of the remote controllers 3*a*, 3*b*, 3*c*, 3*d*, and therefore, a one-to-one correspondence between the indoor unit targeted for operation and the remote controller is determined. Specifically, in the example illustrated in FIG. 19, the address of the operation target of the remote controller 3*a* is "001," and therefore, the operation target of the remote controller 3*a* is the indoor unit 22*a*. Similarly, the address of the operation target of the remote controller 3*b* is "002," and therefore, the operation target of the remote controller 3*b* is the indoor unit 22*b*.

When the indoor units 22*a*, 22*b*, 22*c*, 22*d* and the remote controllers 3*a*, 3*b*, 3*d* each change in operation and control contents, a transmission target for each unit is specified by the address, and communication is being established as necessary. For example, when the user performs heating mode operation by the remote controller 3*a*, the remote controller 3*a* specifies the address (001) of the indoor unit 22*a* stored as the operation target in advance, and transmits a heating command. The indoor unit 22*a* having received the heating command from the remote controller 3*a* reflects the received command contents in operation, and specifies the address (101) of the remote controller 3*a* as a command source to transmit a response indicating completion. Moreover, another example will be described. When an operation state is brought by, e.g., switching operation of a control board of the indoor unit 22*b*, the indoor unit 22*b* notifies such operation to the address (102) of the remote controller 3*b* stored as an operation source in advance. The remote controller 3*b* having received the notification from the indoor unit 22*b* reflects the received contents in the display unit, and transmits, to the address (002) of the indoor unit 22*b* as a notification source, a response indicating completion.

Also in the present variation, when the air-conditioning system 200 is in normal operation, the remote controller setting device 1 is not connected, and is connected only in the case of requiring setting for the remote controllers 3*a*, 3*b*, 3*c*, 3*d*. In the case of the present variation, the remote controller setting device 1 is connected to the air-conditioning apparatus communication line 4. Specifically, the terminal block 13 of the remote controller setting device 1 and the terminal block of the remote controller 3 connected to the air-conditioning apparatus communication line 4 are connected together via the wire by, e.g., the alligator clip or terminal block joint-fastening. Note that a connection location of the remote controller setting device 1 is not limited to the terminal block of the remote controller 3, and the remote controller setting device 1 may be connected to, e.g., each terminal block of the indoor units 22*a*, 22*b* connected to the air-conditioning apparatus communication line 4.

Moreover, in the present variation, the remote controller setting device 1 specifies the addresses of the remote controllers 3*a*, 3*b*, 3*c*, 3*d*, thereby setting the remote controllers 3*a*, 3*b*, 3*c*, 3*d*. Thus, reconnection of the remote controller setting device 1 is not necessary for each system of the air-conditioning device 2, and a setting process load is reduced.

Further, the air-conditioning system 200 of the present variation is not configured to perform the regular communication at regular intervals, but employs the event communication technique of performing communication at irregular timing only in the case of requiring communication to be transmitted due to, e.g., user operation. In a case where the predetermined time period t4 is elapsed after completion of the previous communication in the air-conditioning apparatus communication line 4, the communication unit 16 transmits the divided n pieces of the setting data. The previous communication in this case is the response to the setting data in the case of transmitting the setting data and is the response communication (e.g., the response in communication between the indoor units) other than communication between the remote controller setting device 1 and the setting target unit (the remote controllers 3*a* to 3*d*). Moreover, in a case where other communication, i.e., the response communication other than communication between the remote controller setting device 1 and the setting target unit, is made on the air-conditioning apparatus communication line 4, the communication unit 16 does not transmit the setting data. Note that the flow of the setting processing in the present variation is similar to that of FIG. 18.

Figure 20:
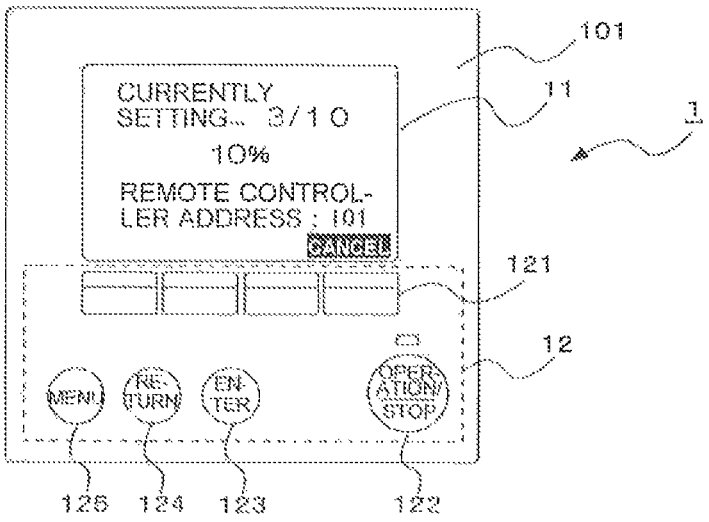
FIG. 20 is a view of a display example of the progress of setting processing in the variation.

During the setting processing, the addresses of the remote controllers 3*a*, 3*b*, 3*c*, 3*d* in the middle of setting processing may be displayed on the display unit 11. FIG. 20 is a view of a display example of the progress of setting processing in the present variation. As illustrated in FIG. 20, the address of the remote controller in the middle of the setting processing is displayed in addition to the progress, and therefore, the user can check which one of the remote controllers is currently being set.

Figure 21:
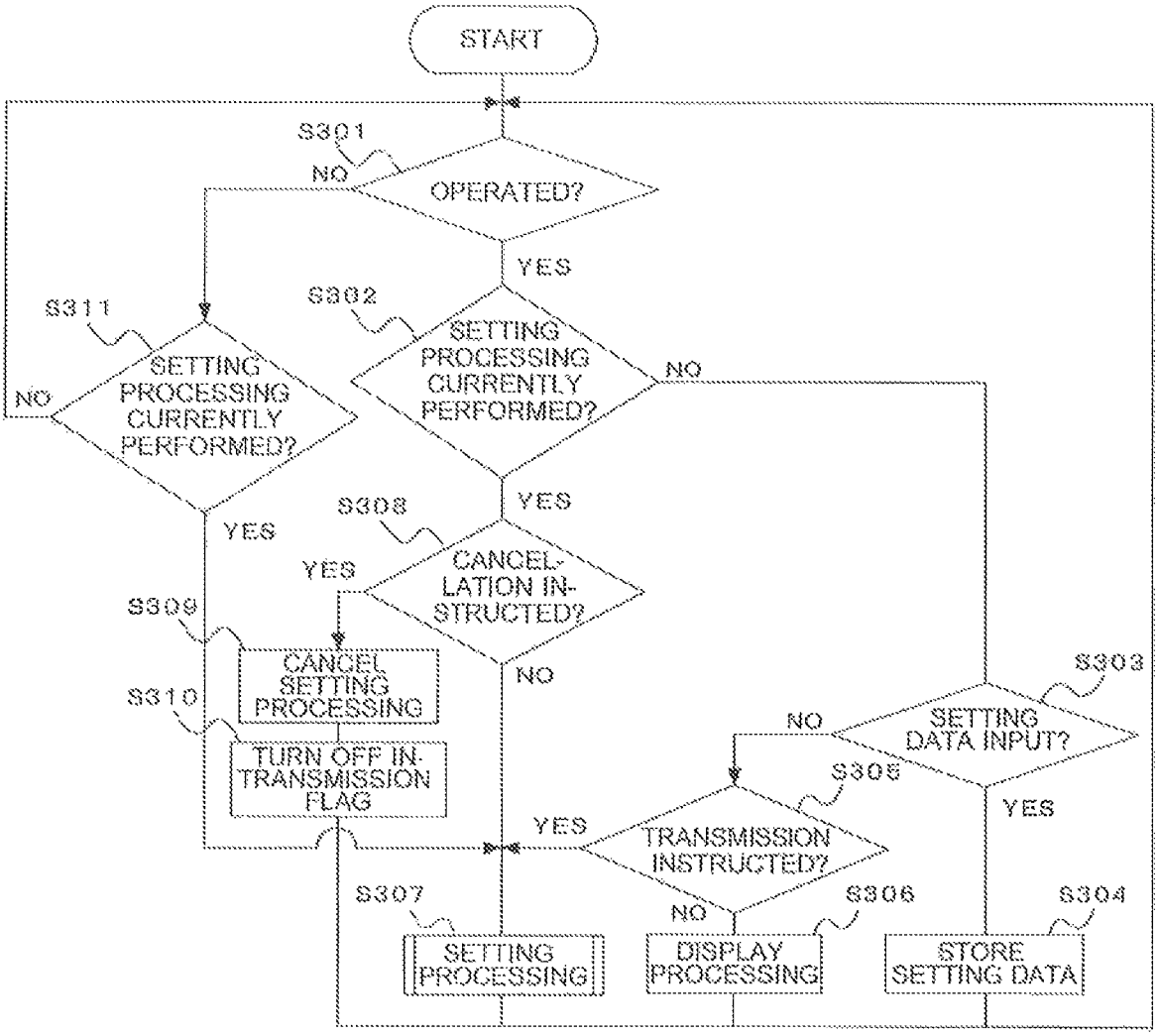
FIG. 21 is a flowchart of operation of a remote controller setting device in a variation.

In Embodiment 1 described above, it is configured such that input of the setting contents and the setting processing in the remote controller setting device 1 are sequentially performed. However, the present invention is not limited to such a configuration. It may be configured such that input of the setting contents and the setting processing are performed in parallel. FIG. 21 is a flowchart of operation of the remote controller setting device 1 in a variation. The present processing begins when the remote controller setting device 1 is connected to the remote controller communication line 5 and is powered ON, and ends when the remote controller setting device 1 is powered OFF. In the present processing, it is first determined whether or not the operation unit 12 is operated (S301). Then, in a case where the operation unit 12 is operated (S301: YES), it is determined whether or not the setting processing is being currently performed (S302). Determination on whether or not the setting processing is being performed is made based on ON/OFF of an in-transmission flag stored in the storage unit 15.

Then, in a case where the setting processing is not being currently performed (S302: NO), it is determined whether or not the operation contents indicate input of the setting data (S303). At this step, in a case where the operation of newly performing setting or the operation of changing the settings is made, it is determined that the operation contents indicate input of the setting data. Then, in a case where the operation contents indicate input of the setting data (S303: YES), the input setting data is stored in the storage unit 15 (S304). On the other hand, in a case where the operation contents do not indicate input of the setting data (S303: NO), it is determined whether or not the operation contents indicate the instruction of transmitting the setting data (S305).

Then, in a case where the operation contents do not indicate the instruction of transmitting the setting data (S305: NO), the processing of changing the indication on the display unit 11 according to the operation contents is performed (S306). On the other hand, in a case where the operation contents indicate the instruction of transmitting the setting data (S305: YES), the setting processing for the remote controller 3 begins (S307).

Figure 22:
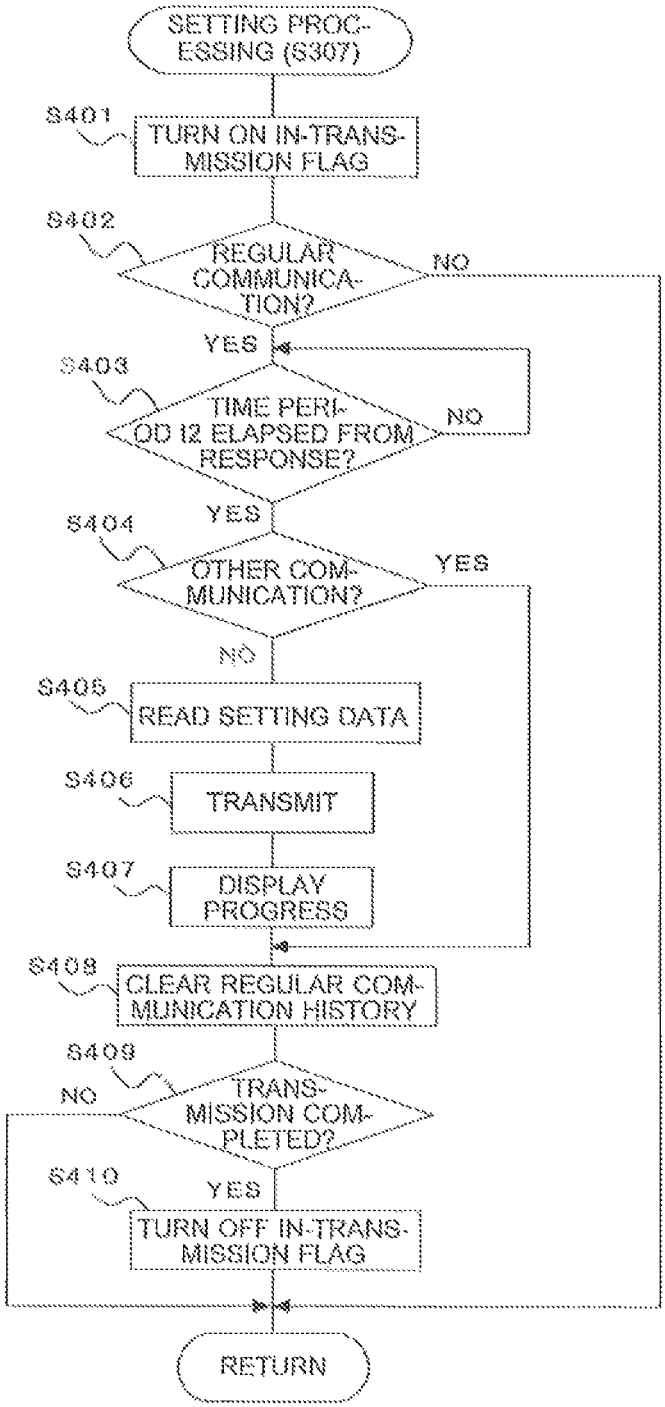
FIG. 22 is a flowchart of the setting processing in the variation.

FIG. 22 is a flowchart of the setting processing in the present variation. In the present processing, the in-transmission flag stored in the storage unit 15 is first turned ON (S401). Then, it is determined whether or not the regular communication is being established on the remote controller communication line 5 (S402). At this step, in a case where the regular communication is not made (S402: NO), the setting processing is terminated. On the other hand, in a case where the regular communication is being established (S402: YES), the time from the point of detection of the response in the regular communication is measured by the timing unit 17, and then, it is determined whether or not the predetermined time period t2 has been elapsed after the response in the regular communication (S403). Then, in a case where the predetermined time period t2 has not been elapsed after the response in the regular communication (S403: NO), a standby state is maintained until the predetermined time period t2 is elapsed.

On the other hand, in a case where the predetermined time period t2 has been elapsed after the response in the regular communication (S403: YES), it is determined whether or not other communication is being established on the remote controller communication line 5 (S404). Then, in a case where other communication is being established (S404: YES), the processing proceeds to a step S408. On the other hand, in a case where other communication is not made (S404: NO), the non-transmitted setting data is read from the storage unit 15 (S405), and then, is transmitted to the remote controller communication line 5 (S406). Then, the progress of setting processing is displayed on the display unit 11 (S407).

Then, the history of the regular communication is cleared (S408), and then, it is determined whether or not transmission has been completed (S409). At this step, it is determined whether or not transmission of all pieces of the setting data stored in the storage unit 15 is completed. Then, in a case where transmission has not been completed yet (S409: NO), the setting processing is terminated. On the other hand, in a case where transmission has been completed (S409: YES), the in-transmission flag is turned OFF (S410), and the setting processing is terminated. After termination of the setting processing, the processing returns to the step S301 of FIG. 21.

Referring back to FIG. 21, in a case where the operation unit 12 is operated at the step S301 (S301: YES) and a case where it is determined, at the step S302, that the setting processing is being performed (S302: YES), it is determined whether or not the operation contents indicate the instruction of canceling the setting processing (S308). Then, in a case where the operation contents do not indicate the instruction of canceling the setting processing (S308: NO), the setting processing is performed (S307). On the other hand, in a case where the operation contents indicate the instruction of canceling the setting processing (S308: YES), the setting processing is canceled (S309), and then, the in-transmission flag is turned OFF (S310).

In a case where the operation unit 12 is not operated at the step S301 (S301: NO), it is determined, based on the in-transmission flag, whether or not the setting processing is being currently performed (S311). Then, in a case where the setting processing is not being currently performed (S311: NO), the processing returns to the step S301. In a case where the setting processing is being performed (S311: YES), the setting processing is performed (S307). As described above, input of the setting contents and the setting processing are performed in parallel, and therefore, the setting processing time can be shortened.

Further, in Embodiment 3 described above, it is configured such that the setting data input by the data input device 7 is read into the remote controller setting device 1A via the external memory 6. However, it may be configured such that the data input device 7 and the remote controller setting device 1A are connected together and the setting data input by the data input device 7 is written in the remote controller setting device 1A.

Moreover, in a case where the remote controller 3 is configured to perform wireless communication, the remote controller setting device 1 may transmit the setting data via wireless communication.

REFERENCE SIGNS LIST

1, 1A remote controller setting device 2, 2A air-conditioning device 3, 3*a*, 3*b*, 3*c*, 3*d* remote controller 4 air-conditioning apparatus communication line

5 remote controller communication line 6 external memory 7 data input device 11 display unit 12 operation unit 13 terminal block 14 control unit

15 storage unit 16 communication unit 17 timing unit 18 external memory insertion unit 19 external memory interface unit 21 outdoor unit 22*a*, 22*b*, 22*c*, 22*d* indoor unit 100, 100A, 200 air-conditioning system 101 front portion 102 back portion 121 function key 122 operation/stop key 123 enter key 124 return key 125 menu key

The invention claimed is:

1. A remote controller setting device comprising:

a storage unit configured to store setting data on a setting content of a remote controller; and a communication unit connected to a wired communication line between the remote controller and a device to be operated by the remote controller and, in normal operation of the remote controller, configured to transmit the setting data stored in the storage unit to the remote controller, wherein the remote controller setting device is physically connected to the wired communication line only in setting the remote controller.

2. The remote controller setting device of claim 1, wherein the communication unit is configured to transmit the setting data in multiple pieces, the setting data being stored in the storage unit.

3. The remote controller setting device of claim 2, wherein the remote controller is configured to regularly communicate with the device to be operated, and the communication unit is configured to transmit the setting data in an interval of the regular communication between the remote controller and the device to be operated.

4. The remote controller setting device of claim 2, wherein the communication unit is configured to transmit the setting data at a predetermined time interval.

5. The remote controller setting device of claim 3, wherein the communication unit is configured to stop transmission of the setting data in a case where communication is being established on the wired communication line.

6. The remote controller setting device of claim 1, wherein the communication unit is configured to start transmission of the setting data at a set day or time.

7. The remote controller setting device of claim 1, wherein the communication unit is configured to start transmission of the setting data after a lapse of a set time from when transmission is instructed by an operator.

8. The remote controller setting device of claim 1, further comprising an operation unit to which the setting data is input, wherein the storage unit is configured to store the setting data input via the operation unit, and the operation unit includes a plurality of function keys.

9. The remote controller setting device of claim 8, wherein the operation unit has a key configuration identical to that of an operation unit of the remote controller.

10. The remote controller setting device of claim 1, further comprising:

an external memory insertion unit into which an external memory is inserted; and an external memory interface unit configured to read data stored in the external memory inserted into the external memory insertion unit, wherein the external memory is configured to store the setting data, and the storage unit is configured to store the setting data read by the external memory interface unit and stored in the external memory.

11. The remote controller setting device of claim 1, further comprising a display unit configured to display a progress of the transmission of the setting data.

12. The remote controller setting device of claim 1, wherein the remote controller includes a plurality of remote controllers, the plurality of remote controllers being connected to the wired communication line, and the communication unit is configured to specify an address assigned to each remote controller, thereby determining a transmission destination of the setting data.

13. The remote controller setting device of claim 1, wherein the setting data on the setting content of the remote controller stored in the storage unit includes a setting of time and operation for a weekly schedule, a setting of time and operation for an ON-OFF timer, a time setting of an automatic OFF timer, a temperature unit display setting, a time display setting, or a contrast setting.

* * * * *